US010773909B2

(12) United States Patent
Bonetsmüller et al.

(10) Patent No.: US 10,773,909 B2
(45) Date of Patent: Sep. 15, 2020

(54) APPARATUS FOR FEEDING A PLURALITY OF FLAT ELEMENTS LYING FLAT ON ONE ANOTHER, IN PARTICULAR CARTON BLANKS, TO A PACKAGING APPARATUS

(71) Applicant: SOMIC Verpackungsmaschinen GmbH & Co. KG, Amerang (DE)

(72) Inventors: Manfred Bonetsmüller, Amerang (DE); Norbert Eder, Amerang (DE)

(73) Assignee: SOMIC Verpackungsmaschinen GmbH & Co. KG, Amerang (DE)

( * ) Notice: Subject to any disclaimer, the term of this patent is extended or adjusted under 35 U.S.C. 154(b) by 0 days.

(21) Appl. No.: 16/330,509

(22) PCT Filed: Sep. 22, 2017

(86) PCT No.: PCT/EP2017/074086
§ 371 (c)(1),
(2) Date: Mar. 5, 2019

(87) PCT Pub. No.: WO2018/055103
PCT Pub. Date: Mar. 29, 2018

(65) Prior Publication Data

US 2019/0193885 A1 Jun. 27, 2019

(30) Foreign Application Priority Data

Sep. 23, 2016 (DE) ..... 20 2016 005 874 U

(51) Int. Cl.

| | |
|---|---|
| ***B65H 1/02*** | (2006.01) |
| ***B31B 50/04*** | (2017.01) |
| *B65B 43/12* | (2006.01) |

(52) U.S. Cl.
CPC ..... *B65H 1/025* (2013.01); *B31B 50/042* (2017.08); *B65B 43/126* (2013.01); *B65H 2404/2641* (2013.01); *B65H 2404/531* (2013.01)

(58) Field of Classification Search
CPC .. B65H 1/30; B65H 2220/01; B65H 2220/02; B65H 1/025
See application file for complete search history.

(56) References Cited

U.S. PATENT DOCUMENTS 3,680,854 A 8/1972 Daily et al.
3,858,490 A * 1/1975 Heisler ..... B65B 5/08 493/316

(Continued)

FOREIGN PATENT DOCUMENTS

DE 68903669 4/1993
DE 69908159 4/2004

(Continued)

OTHER PUBLICATIONS

German Search Report of German patent application No. 20 2016 005 874.7 dated May 2, 2017, 5 pages.

(Continued)

*Primary Examiner* — Gregory W Adams
(74) *Attorney, Agent, or Firm* — Rankin, Hill & Clark LLP

(57) ABSTRACT

The invention relates to an apparatus (10) for feeding a plurality of flat elements (12) lying flat on one another, in particular carton blanks, to a packaging apparatus (V), comprising: a first feed section (18) having a conveying device (46), of which the conveying surface (22*a*1) intended to support the flat elements (12) is formed from a material which, with respect to the interaction with the flat elements (12), has a predetermined coefficient of adhesive friction, and a second feed section (20), which falls toward the (Continued)

packaging apparatus (V), wherein the inclination of the first feed section (18) and the inclination of the second feed section (20) toward the packaging apparatus (V) are different from each other.

20 Claims, 3 Drawing Sheets

(56) References Cited

U.S. PATENT DOCUMENTS 4,052,052 A * 10/1977 Muller ..... B65H 1/30 271/157
4,518,301 A * 5/1985 Greenwell ..... B65H 3/42 221/36
4,588,180 A * 5/1986 Ballestrazzi ..... B65H 1/24 271/150
4,596,545 A * 6/1986 Greenwell ..... B65H 3/42 271/95
4,797,258 A * 1/1989 Mochida ..... G01N 35/021 198/411
4,928,942 A * 5/1990 Aiuola ..... B65H 1/22 270/58.01
4,934,682 A * 6/1990 Rece ..... B65H 1/02 271/113
4,981,292 A * 1/1991 Cosgrove ..... B65H 1/025 271/150
5,131,899 A 7/1992 Nagahashi et al.
5,211,529 A * 5/1993 Esala ..... B65H 1/30 271/150
5,244,199 A * 9/1993 Wood ..... B65H 1/30 271/150
5,511,772 A * 4/1996 Ganz ..... B65B 43/185 271/108
5,653,671 A * 8/1997 Reuteler ..... B65H 1/24 493/313
6,036,186 A * 3/2000 Glanzmann ..... B65H 1/025 271/150
6,044,959 A * 4/2000 Monsees ..... B65G 21/2036 198/461.1
6,138,819 A * 10/2000 Bogle ..... B65G 47/66 198/325
6,186,208 B1 * 2/2001 McGilvery ..... B65B 5/106 156/443
6,276,893 B1 * 8/2001 Pluschow ..... B65B 43/185 271/157
6,447,435 B2 9/2002 Greenwell
7,311,191 B2 * 12/2007 Bahr ..... B65G 47/2445 198/396
7,594,646 B2 * 9/2009 Flagg ..... B65B 43/185 271/150
7,793,929 B2 * 9/2010 Hendricks ..... B65H 1/025 271/148
8,209,945 B2 * 7/2012 May ..... B65B 39/007 53/138.4
8,246,290 B2 * 8/2012 May ..... B65B 43/185 271/166
8,371,216 B2 * 2/2013 Chisholm ..... B41J 3/60 101/35
8,480,077 B2 * 7/2013 Dunn ..... B65H 5/021 271/202
8,573,382 B2 * 11/2013 Bastasch ..... B65G 47/24 198/390
2008/0290592 A1 * 11/2008 Richter ..... B65H 1/02 271/258.01
2009/0087296 A1 4/2009 May et al.
2015/0063974 A1 * 3/2015 Malenke ..... A21C 9/08 414/797.8

FOREIGN PATENT DOCUMENTS

EP 0339178 11/1989
FR 2564065 11/1985
WO 2007084261 7/2007

OTHER PUBLICATIONS

Written Opinion and International Search Report of PCT/EP2017/074086 dated Dec. 12, 2017,15 pages (English and German).
International Preliminary Report on Patentability of PCT/EP2017/074086 dated Apr. 4, 2019, 8 pages.

* cited by examiner

APPARATUS FOR FEEDING A PLURALITY OF FLAT ELEMENTS LYING FLAT ON ONE ANOTHER, IN PARTICULAR CARTON BLANKS, TO A PACKAGING APPARATUS

The invention relates to an apparatus for feeding a plurality of planar elements, resting against on one another, in particular carton blanks, to a packaging apparatus, comprising a first feed portion having a conveying means, the conveying surface of which, intended for supporting the planar elements, is formed of a material that has a specified coefficient of static friction with respect to the interaction with the planar elements, and comprising a second feed portion that slopes downwards towards the packaging apparatus, the inclination of the first feed portion and the inclination of the second feed portion towards the packaging apparatus being different from one another.

It should already be noted at this point that, within the meaning of the present invention, the term "feed portion" denotes a longitudinal portion of the feed apparatus that has a specified inclination, over the entire length thereof, towards the packaging apparatus. Furthermore, for the sake of simplicity, the invention will be explained in the following with reference to the example of carton blanks. However, no limitation of any kind can be derived therefrom.

Feed apparatuses (not of the type in question) are known from the prior art which comprise a single feed portion that slopes downwards towards the packaging apparatus. In this case, the conveying surface of the conveying means that extends over the entire length of said feed portion is formed of a material, the coefficient of static friction of which with respect to the carton blanks is selected such that the carton blanks can be conveyed towards the packaging apparatus in a manner substantially free of slip relative to the conveying surface. If it is taken into account that the length of the feed portion is generally dimensioned such that the feed portion can receive sufficient carton blanks for the loading of the packaging apparatus to be ensured for several minutes, it is clearly apparent that the gravity-induced pressure (back pressure) that the entirety of the carton blanks exerts on the adjacent carton blanks on the packaging apparatus, owing to the inclination of the feed portion, can reach a value that makes it more difficult, and sometimes even impossible, to separate the carton blanks using a gripper unit, generally comprising a vacuum gripper, at the start of the packaging apparatus. This results in undesired downtimes of the packaging apparatus.

In order to overcome this problem, feed apparatuses (of the type in question) have already been proposed which comprise a substantially horizontal first feed portion comprising a conveying means, and a second feed portion that slopes downwards towards the packaging apparatus and does not comprise a conveying means. This arrangement makes it possible to significantly reduce the back pressure, since the carton blanks arranged in the horizontal first feed portion cannot contribute to said pressure. However, it has been found in practice that said feed apparatuses are prone to canting of the adjacent carton blanks at the end of the second feed portion of the packaging apparatus. In this case, it should be noted that, also according to the invention, the carton blanks are preferably fed to the packaging apparatus in an orientation in which a peripheral edge of said blanks stands upright on the first feed portion and the second feed portion.

The object of the present invention is that of remedying this situation.

This object is achieved according to the invention by a feed apparatus of the type mentioned at the outset, in which the second feed portion comprises a further conveying means, the conveying surface of which, intended for supporting the planar elements, is formed of a material, the coefficient of static friction of which with respect to the interaction with the planar elements, in particular carton blanks, has a lower value than the material of the conveying means of the first feed portion.

Owing to the low coefficient of static friction of the conveying surface of the further conveying means, the peripheral edge of the carton blanks can slide along on said conveying surface, making it possible to achieve the advantages of the generic prior art even in the case of the feed apparatus according to the invention. At the same time, despite the low coefficient of static friction, the carton blanks nonetheless receive a conveying momentum, in each conveying cycle, which, as has been proven strikingly in practice, is sufficient for counteracting canting of the carton blanks.

It is advantageously possible for the coefficient of static friction of the conveying surface of the further conveying means to be selected such that the static friction between the conveying surface and the carton blanks is overcome during a conveying cycle of the further conveying means, such that slip results between the conveying surface and the carton blanks.

For example, the conveying surface of the conveying means of the first feed portion may be formed of polyurethane, and/or the conveying surface of the further conveying means of the second feed portion may be formed of Teflon. Alternatively, the conveying surface of the conveying means of the first feed portion could be formed of elastomer, natural rubber, a polyamide woven fabric or silicone, and the conveying surface of the further conveying means of the second feed portion could be formed of PVC or a steel coating.

In order to achieve mutually coordinated operation of the two conveying means, it may further be possible for the conveying means of the first feed portion and the further conveying means of the second feed portion to be associated with a common drive unit. In this case, in order to allow for the drive force of the common drive unit to be transferred between the two conveying means, it may be possible for the two conveying means to be drivingly interconnected at the transition from the first feed portion to the second feed portion. This can be achieved for example in that a deflection unit is arranged at the transition from the first feed portion to the second feed portion, which deflection unit deflects both the conveying surface of the conveying means of the first feed portion and the conveying surface of the further conveying means of the second feed portion.

According to a development of the invention, one conveying means and/or the further conveying means comprises at least one conveyor belt which is formed by a toothed belt for example. In this case, the surface of the at least one conveyor belt that faces the carton blanks forms the conveying surface or a portion of the conveying surface of one conveying means or of the further conveying means.

In this connection, it is furthermore possible for the deflection unit to comprise a rotatable shaft on which at least one deflection wheel associated with the conveyor belt of the first feed portion, as well as a deflection wheel associated with the further conveying means of the second feed portion, are arranged. Alternatively, the two deflection wheels may also be formed integrally with one another and be rotatably mounted by means of a common pivot bearing. In the case of toothed belts being used, the deflection wheels can advantageously be formed as gear wheels. In this case, the toothed belt/gear wheel drive combination allows for particularly precise driving of one conveying means and/or of the further conveying means.

According to a development of the invention, the feed apparatus comprises at least two feed units, each of which comprises at least one conveyor belt associated with the first feed portion, and a conveyor belt associated with the second feed portion, said conveyor belts being arranged on a common carrier. Advantageously, the conveyor belts of each feed unit are of the same width.

In order to be able to ensure disruption-free transition of the carton blanks from the first feed portion to the second feed portion, it is advantageous for the conveyor belts to be arranged adjacently to one another at the transition from the first feed portion to the second feed portion. In this case, it is preferable for the spacing between the two conveyor belts to be smaller than the width of said belts or smaller than the width of the narrower of the two conveyor belts.

The feed apparatus may furthermore comprise a frame, on which the at least two feed units are arranged so as to be displaceable relative to one another transversely to the conveying direction. This makes it possible to use the feed apparatus for planar elements, in particular carton blanks, of different widths.

Finally, it should be noted that, as is known per se from the prior art, the first feed portion can advantageously extend so as to be substantially horizontal. This makes it possible for said feed portion to be of any desired length without a back pressure being generated thereby that could act on the adjacent carton blanks at the end of the second feed portion of the packaging apparatus.

Furthermore, the second feed portion may have an angle of inclination of between approximately 5° and approximately 40° relative to the horizontal, positive angle values indicating a progression of the second feed portion that slopes downwards in the conveying direction, towards the packaging apparatus.

The invention will be explained in greater detail in the following, on the basis of an embodiment and with reference to the accompanying drawings. In the drawings.

Figure 1:
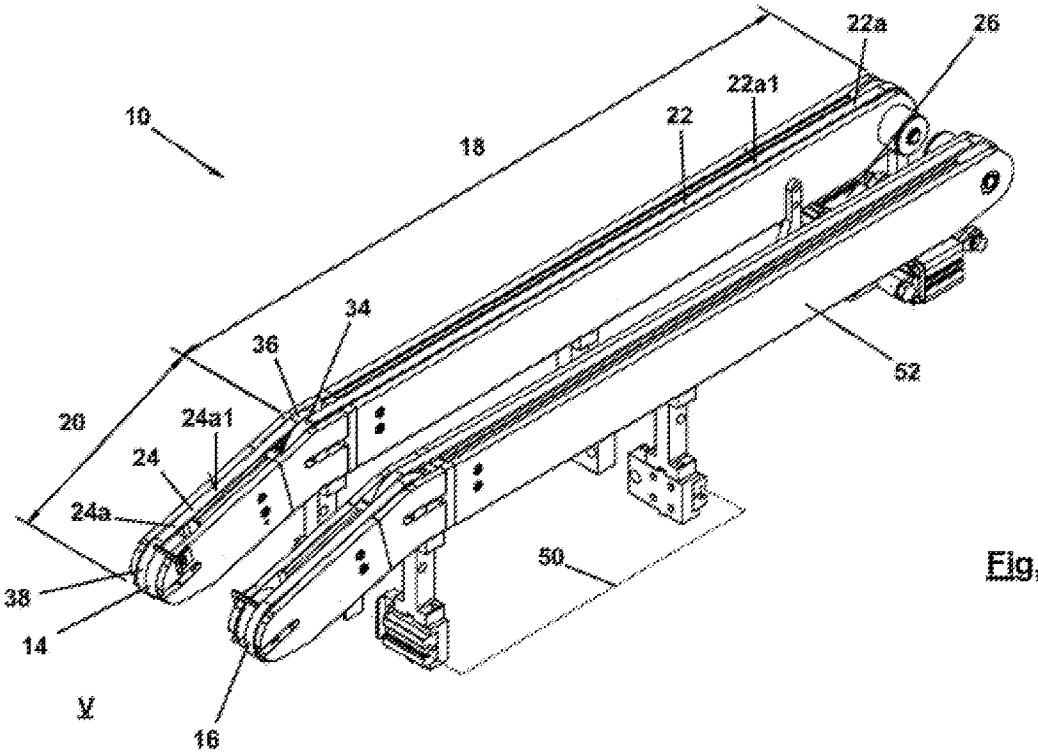
FIG. 1 is a perspective view of a feed apparatus according to the invention.
Figure 2:
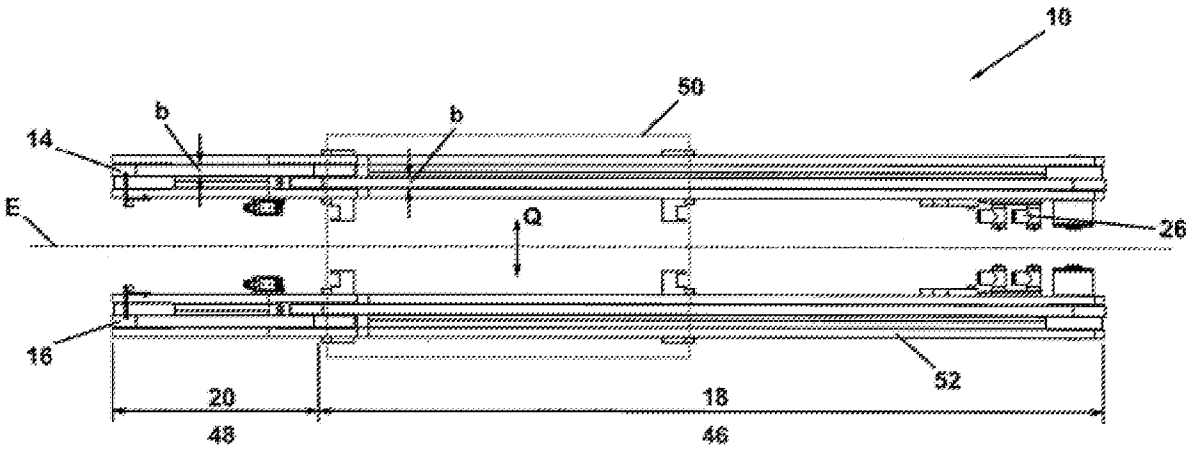
FIG. 2 is a plan view of the feed apparatus according to the invention.
Figure 3:
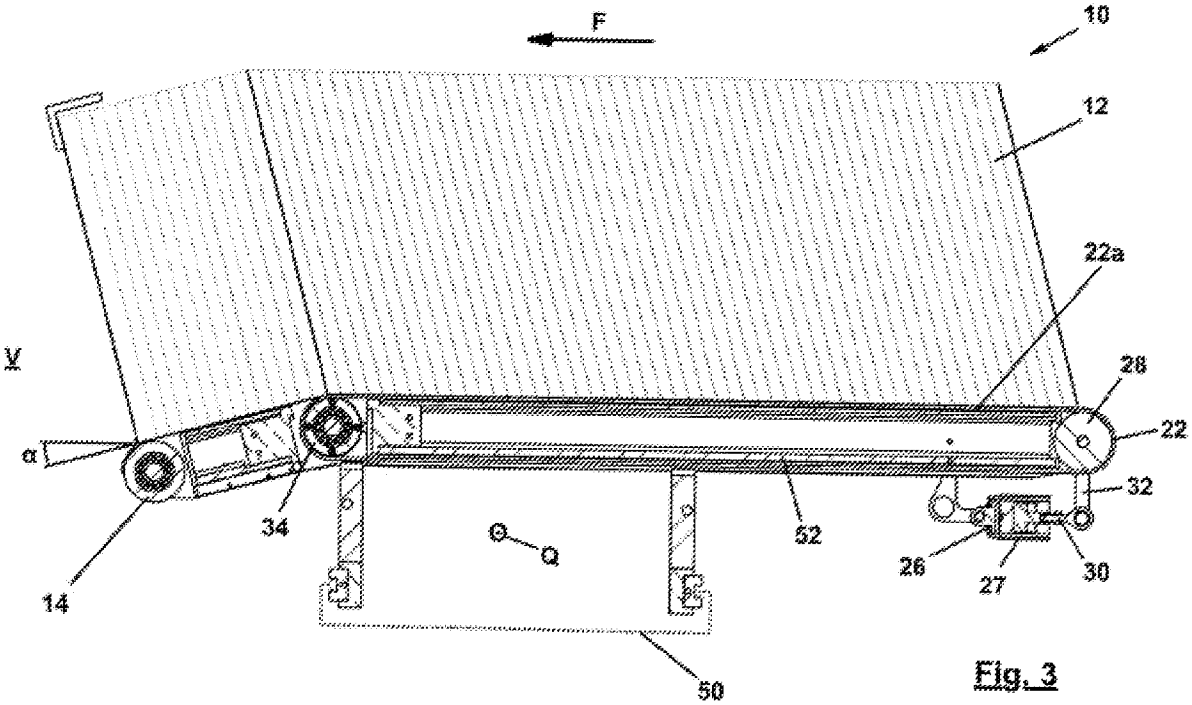
FIG. 3 is a side view of the feed apparatus according to the invention.

In FIGS. 1 to 3, a feed apparatus according to the invention is denoted very generally by 10.

Said apparatus is used for feeding a plurality of planar elements 12 (see FIG. 3), resting flat against one another, in particular carton blanks, to a packaging apparatus, the position of which is indicated merely in a highly schematic manner in FIG. 3 by the reference sign V.

The feed apparatus 10 comprises two feed units 14 and 16 which are arranged so as to be mirror-symmetrical with respect to a longitudinal central plane E (see FIG. 2) of the feed apparatus 10, but are otherwise designed identically. The design of the feed units 14 and 16 will therefore be described in the following merely with reference to the example of the feed unit 14.

The feed unit 14, and thus also the feed apparatus 10, comprises two feed portions 18 and 20, each of which comprises a conveyor belt 22 and 24, respectively, which are both preferably formed by a toothed belt. In this case, the conveyor belt 22 is driven by a drive means 26 which can be seen most clearly in FIG. 3 and acts on a drive wheel 28.

In the embodiment shown, the drive means 26 is formed by a piston-cylinder unit 27 which, in FIG. 3, rotates the drive wheel 28 in an anti-clockwise direction, by a specified angle, by means of a lever 32 connected to the piston rod 30, upon each actuation, and thus moves the upper run 22*a* of the conveyor belt 22 by a specified distance in the conveying direction F, i.e. towards the packaging apparatus V. Upon a return stroke of the piston-cylinder unit 27, a free wheel (not shown) ensures that the drive wheel 28 pauses in the position thereof.

A deflection wheel 34 for the conveyor belt 22 is arranged at the transition from the first feed portion 18 to the second feed portion 20. Said deflection wheel 34 is arranged on the same shaft as a deflection wheel 36 of the second conveyor belt 24. In this case, the two deflection wheels 34 and 36 are interconnected for conjoint rotation, such that the drive movement of the conveyor belt 22 can be transmitted to the conveyor belt 24. As a result, it is not necessary to provide a separate drive means for the conveyor belt 24. However, for the sake of completeness the deflection wheel 38 of the second conveyor belt 24 should also be mentioned, which wheel is arranged on the end of the feed apparatus 10 that faces the packaging apparatus V.

It should also be noted at this point that the surface 22*a*1 of the upper run 22*a* of the conveyor belt 22, and the surface 24*a*1 of the upper run 24*a* of the conveyor belt 24 each form a conveying surface on which the carton blanks 12, specifically, as can be seen from FIG. 3, the peripheral edges thereof, stand upright during operation of the feed apparatus 10, i.e. on the route to the packaging apparatus V.

Figure 4:
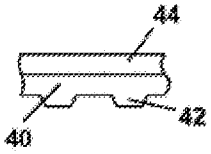
FIG. 4 is a schematic view of the structure of the conveyor belts of the feed apparatus according to the invention.

Both conveyor belts 22 and 24 may be formed as toothed belts, in which case the deflection wheels 28, 34, 36 and 38 are formed as gear wheels. As shown schematically in FIG. 4, both conveyor belts 22 and 24 comprise a first layer 40 which provides contact with the deflection wheels 28, 34, 36 and 38 and, when the conveyor belts are formed as toothed belts, also carries the toothing 42 thereof. Furthermore, both conveyor belts 22 and 24 comprise a second layer 44 which comes into contact with the carton blanks 12. According to the invention, the second layer 44 of the conveyor belt 22 is formed of a material that has a higher coefficient of static friction than the material of the second layer 44 of the conveyor belt 24. For example, the second layer 44 of the conveyor belt 22 may be formed of polyurethane, while the second layer 44 of the conveyor belt 24 may be formed of Teflon.

As can be seen in particular in FIG. 3, the first feed portion 18 extends so as to be substantially horizontal, while the second feed portion 20 slopes downwards in the conveying direction F. In this case, the angle of inclination a is preferably between approximately 5° and approximately 40°.

It should be noted at this point that the conveyor belts 22 of the first feed portions 18 of the two conveying units 14 and 16, and the further elements required for driving said conveyor belts 22, together form a first conveying means 46 of the feed apparatus 10, while the conveyor belts 24 of the second feed portions 20 and the further elements required for driving said conveyor belts together form a second conveying means 48 of the feed apparatus 10 (see FIG. 2).

As can be seen in particular in FIG. 2, the two conveyor belts 22 and 24 are arranged so as to be directly adjacent to one another, in the region of the transition from the first feed portion 18 to the second feed portion 20. In this case, however, said belts preferably do not rest on one another, since this would lead to wear, but instead are at a spacing from one another that is smaller than the width b of the two conveyor belts 22 and 24 (see FIG. 2).

It should furthermore be noted that the two feed units 14 and 16 are formed as self-contained modules which are arranged on a frame 50 of the feed apparatus 10 so as to be adjustable relative to one another in the transverse direction Q, i.e. in the direction orthogonal to the conveying direction F. For this purpose, all the components of the feed units 14 and 16, i.e. the conveyor belts 22 and 24 and all the elements required for driving said belts, are arranged on a common carrier 52.

The invention claimed is:

1. A feed apparatus for feeding a plurality of planar elements, resting flat against one another, in particular carton blanks, to a packaging apparatus, comprising:

a first feed portion having a first feed portion conveyor belt, the first feed portion conveying surface of which supports the planar elements and is formed of a first material that has a specified coefficient of static friction with respect to the interaction with the planar elements, and a second feed portion having a second feed portion conveyor belt, the second feed portion conveying surface of which supports the planar elements and is formed of a second material that has a coefficient of static friction of which with respect to the interaction with the planar elements has a lower value than the first material of the first feed portion, wherein the second feed portion slopes downwards towards the packaging apparatus, wherein a first feed portion angular orientation of the first feed portion and a second feed portion angular orientation of the second feed portion towards the packaging apparatus are different from one another; and wherein the first feed portion conveying surface of the first feed portion conveyor belt of the first feed portion is formed of polyurethane and/or in that the second feed portion conveying surface of the second feed portion conveyor belt of the second feed portion is formed of Teflon.

2. Feed apparatus according to claim 1, wherein the coefficient of static friction of the second feed portion conveying surface of the second feed portion conveyor belt is selected such that the static friction between the second feed portion conveying surface and the planar elements is overcome during a conveying cycle of the second feed portion conveyor belt, such that slip results between the second feed portion conveying surface and the planar elements.

3. Feed apparatus according to claim 1, wherein the first feed portion conveyor belt of the first feed portion and the second feed portion conveyor belt of the second feed portion are associated with a common drive unit.

4. Feed apparatus according to claim 3, wherein the both the first feed portion conveyor and the second feed portion conveyor belt are drivingly interconnected at the transition from the first feed portion to the second feed portion.

5. Feed apparatus according to claim 3, wherein a deflection unit is arranged at the transition from the first feed portion to the second feed portion, which deflection unit deflects both the first feed portion conveying surface of the first feed portion conveyor belt of the first feed portion and the second feed portion conveying surface of the second feed portion conveyor belt of the second feed portion.

6. Feed apparatus according to claim 5, wherein the deflection unit comprises a rotatable shaft on which at least one deflection wheel associated with the first feed portion conveyor belt of the first feed portion, as well as at least one second deflection wheel associated with the second feed portion conveyor belt of the second feed portion, are arranged.

7. Feed apparatus according to claim 6, further including a first feed unit and a second feed unit, wherein the first feed unit includes the first feed portion and the second feed portion, and wherein the first and second feed units are arranged so as to be mirror-symmetrical with respect to a longitudinal central plane but are otherwise identical to one another, and further wherein the first and second units are arranged on a common carrier.

8. Feed apparatus according to claim 7, wherein the first feed portion and second feed portion conveyor belts are arranged adjacently to one another at the transition from the first feed portion to the second feed portion.

9. Feed apparatus according to claim 7, further including a frame, on which the first and second feed units are arranged so as to be displaceable relative to one another transversely to the conveying direction.

10. Feed apparatus according to claim 1, wherein at least one of the first feed portion conveyor belt and the second feed portion conveyor belt is formed by a toothed belt.

11. Feed apparatus according to claim 7, wherein the first feed portion and second feed portion conveyor belts are of the same width.

12. Feed apparatus according to claim 1, wherein the first feed portion extends so as to be substantially horizontal.

13. Feed apparatus according to claim 1, wherein the second feed portion inclination is disposed at an angle of between approximately 5° and approximately 40° relative to the horizontal.

14. Feed apparatus according to claim 1 wherein the first feed portion conveying surface of the first feed portion conveyor belt of the first feed portion is formed of polyurethane and in that the second feed portion conveying surface of the second feed portion conveyor belt of the second feed portion is formed of Teflon.

15. A feed apparatus for feeding a plurality of planar elements, resting flat against one another, in particular carton blanks, to a packaging apparatus, comprising:

a first feed portion having a first feed portion conveyor belt, the first feed portion conveying surface of which supports the planar elements and is formed of a first material that has a specified coefficient of static friction with respect to the interaction with the planar elements, and a second feed portion having a second feed portion conveyor belt, the second feed portion conveying surface of which supports the planar elements and is formed of a second material that has a coefficient of static friction of which with respect to the interaction with the planar elements has a lower value than the first material of the first feed portion, wherein the second feed portion slopes downwards towards the packaging apparatus, wherein a first feed portion angular orientation of the first feed portion and a second feed portion angular orientation of the second feed portion towards the packaging apparatus are different from one another, and further including a frame, on which first and second feed units are arranged so as to be displaceable relative to one another transversely to the conveying direction, wherein the first feed unit includes the first feed portion and the second feed portion, and wherein the first and second feed units are arranged so as to be mirror-symmetrical with respect to a longitudinal central plane but are otherwise identical to one another.

16. Feed apparatus according to claim 1, wherein the first feed portion is arranged such that the first feed portion conveyor belt engages a flat planar surface of the planar element, and wherein the second feed portion is arranged such that the second feed portion conveyor belt engages the same flat planar surface of the planar element.

17. A feed apparatus comprising:

a first feed portion having a first feed portion conveyor belt arranged to support a flat surface of an associated planar element to be conveyed by the first feed portion conveyor belt, the first feed portion conveyor belt further arranged at a first angular orientation and having a first feed portion conveying surface formed a first material; and a second feed portion having a second feed portion conveyor belt arranged to support said flat surface of the associated planar element to be conveyed by the second feed portion conveyor belt, the second feed portion conveyor belt further arranged at a second angular orientation and having a second feed portion conveying surface formed of a second material, wherein the second angular orientation is different than the first angular orientation, and wherein the second material has a coefficient of static friction that is less than that of the first material, and further including a first feed unit and a second feed unit, wherein the first feed unit includes the first feed portion and the second feed portion, and wherein the first and second feed units are arranged so as to be mirror-symmetrical with respect to a longitudinal central plane but are otherwise identical to one another, and wherein the first and second feed portion conveying belts are arranged laterally adjacent to one another at the transition from the first feed portion to the second feed portion and the first and second feed units are displaceable relative to one another transversely to the conveying direction.

18. Feed apparatus according to claim 15, wherein the first feed portion conveying surface of the first feed portion conveyor belt of the first feed portion is formed of polyurethane, and/or in that the second feed portion conveying surface of the second feed portion conveyor belt of the second feed portion is formed of Teflon.

19. Feed apparatus according to claim 18 wherein the first feed portion conveying surface of the first feed portion conveyor belt of the first feed portion is formed of polyurethane and in that the second feed portion conveying surface of the second feed portion conveyor belt of the second feed portion is formed of Teflon.

20. Feed apparatus of claim 17 wherein the first and second feed portion conveying belts are driven together by a common drive unit and are drivingly interconnected at a transition from the first feed portion to the second feed portion.

* * * * *